US008365915B2

(12) United States Patent
Hunter et al.

(10) Patent No.: US 8,365,915 B2
(45) Date of Patent: Feb. 5, 2013

(54) WAISTLESS RECTANGULAR PLASTIC CONTAINER

(75) Inventors: Travis A. Hunter, Hellam, PA (US); Raymond A. Pritchett, Jr., Manchester, PA (US)

(73) Assignee: Graham Packaging Company, L.P., York, PA (US)

( * ) Notice: Subject to any disclaimer, the term of this patent is extended or adjusted under 35 U.S.C. 154(b) by 147 days.

(21) Appl. No.: 13/078,542

(22) Filed: Apr. 1, 2011

(65) Prior Publication Data

US 2012/0248003 A1 Oct. 4, 2012

(51) Int. Cl.
*B65D 1/40* (2006.01)

(52) U.S. Cl. ..... 206/524.6; 215/382

(58) Field of Classification Search ..... 215/379, 215/381, 382, 383; 220/669, 674, 675; 206/524.1, 206/524.6

See application file for complete search history.

(56) References Cited

U.S. PATENT DOCUMENTS

| | | | | |
|---|---|---|---|---|
| 4,108,324 | A | 8/1978 | Krishnakumar et al. | |
| 5,908,128 | A | 6/1999 | Krishnakumar et al. | |
| 5,989,661 | A | 11/1999 | Krishnakumar et al. | |
| 6,413,466 | B1 | 7/2002 | Boyd et al. | |
| 6,439,413 | B1 | 8/2002 | Prevot et al. | |
| 6,763,968 | B1 | 7/2004 | Boyd et al. | |
| 6,920,992 | B2 | 7/2005 | Lane et al. | |
| 7,080,747 | B2 | 7/2006 | Lane et al. | |
| 2003/0196926 | A1 | 10/2003 | Tobias et al. | |
| 2004/0211746 | A1 | 10/2004 | Trude | |
| 2007/0045222 | A1 * | 3/2007 | Denner et al. | 215/382 |
| 2008/0000867 | A1 | 1/2008 | Lane et al. | |
| 2008/0314862 | A1 * | 12/2008 | Matsuoka et al. | 215/382 |
| 2010/0155360 | A1 * | 6/2010 | Mast et al. | 215/383 |

* cited by examiner

*Primary Examiner* — Jacob K Ackun
(74) *Attorney, Agent, or Firm* — The Patentwise Group, LLC

(57) ABSTRACT

A blow molded plastic container includes a main body portion that has a substantially rectangular shape when viewed in transverse cross-section. A plurality of side panels are defined on the main body portion. At least one of the side panels has a longitudinally oriented concave scoop that extends continuously from an upper portion of the side panel to a lower portion of the side panel. The side panel further includes a first pair of longitudinally oriented concave ribs that are positioned adjacent to an upper portion of the scoop and a second pair of longitudinally oriented concave ribs that are positioned adjacent to a lower portion of the scoop.

19 Claims, 5 Drawing Sheets

WAISTLESS RECTANGULAR PLASTIC CONTAINER

BACKGROUND OF THE INVENTION

1. Field of the Invention

This invention relates generally to the field of blow molded plastic containers, and more particularly to a lightweight rectangular plastic container.

2. Description of the Related Technology

Many products that were previously packaged using glass containers are now being supplied in plastic containers, such as containers that are fabricated from polyesters such as polyethylene terephthalate (PET).

PET containers are typically manufactured using the stretch blow molding process. This involves the use of a preform that is injection molded into a shape that facilitates distribution of the plastic material within the preform into the desired final shape of the container. The preform is first heated and then is longitudinally stretched and subsequently inflated within a mold cavity so that it assumes the desired final shape of the container. As the preform is inflated, it takes on the shape of the mold cavity. The polymer solidifies upon contacting the cooler surface of the mold, and the finished hollow container is subsequently ejected from the mold.

Plastic containers must be designed to withstand different types of forces without excessive deformation. Adequate column or top load strength is required to prevent buckling or bulging of the container sidewall when the container is subjected to longitudinal compression, for example as a result of stacking of the containers during transportation. In addition, plastic containers must possess adequate circumferential or hoop strength to control deformation as a result of internal and external pressure differences.

In order to minimize material costs, it is desirable to make the sidewall of such containers as thin as possible. Such lightweighting, however, comes at the expense of container strength. Structural features such as grooves and ribs are often used to optimize the strength to weight characteristics of particular containers. For example, containers that have a substantially rectangular transverse cross-section commonly incorporate a narrowed circumferential waist portion, which enhances the hoop strength of the container and limits outward bulging of the container sidewall as a result of internal pressurization.

Another factor that often comes into play in the design of blow molded plastic containers is the suitability for a particular container design for receiving a label, such as a shrink-wrap label. Such labels must bridge structural features such as recessed grooves or the recessed waist of a rectangular container, which can create an unsightly appearance and potentially expose the label to damage when it is contacted by a consumer's fingernails or other object.

A need exists for a rectangular plastic container that possesses superior strength to weight characteristics in order to limit bulging of the container sidewall, while also minimizing deep surface dislocations that could interfere with the function of a label.

SUMMARY OF THE INVENTION

Accordingly, it is an object of the invention to provide a rectangular plastic container that possesses superior strength to weight characteristics in order to limit bulging of the container sidewall, while also minimizing deep surface dislocations that could interfere with the function of a label.

In order to achieve the above and other objects of the invention, a blow molded plastic container according to one aspect of the invention includes a main body portion that has a substantially rectangular shape when viewed in transverse cross-section. A plurality of side panels are defined on the main body portion. At least one of the side panels as a longitudinally oriented concave scoop that extends continuously from an upper portion of the side panel to a lower portion of the side panel. Side panel further includes a first pair of longitudinally oriented concave ribs positioned adjacent to an upper portion of the scoop and a second pair of longitudinally oriented concave ribs that are positioned adjacent to a lower portion of the scoop.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
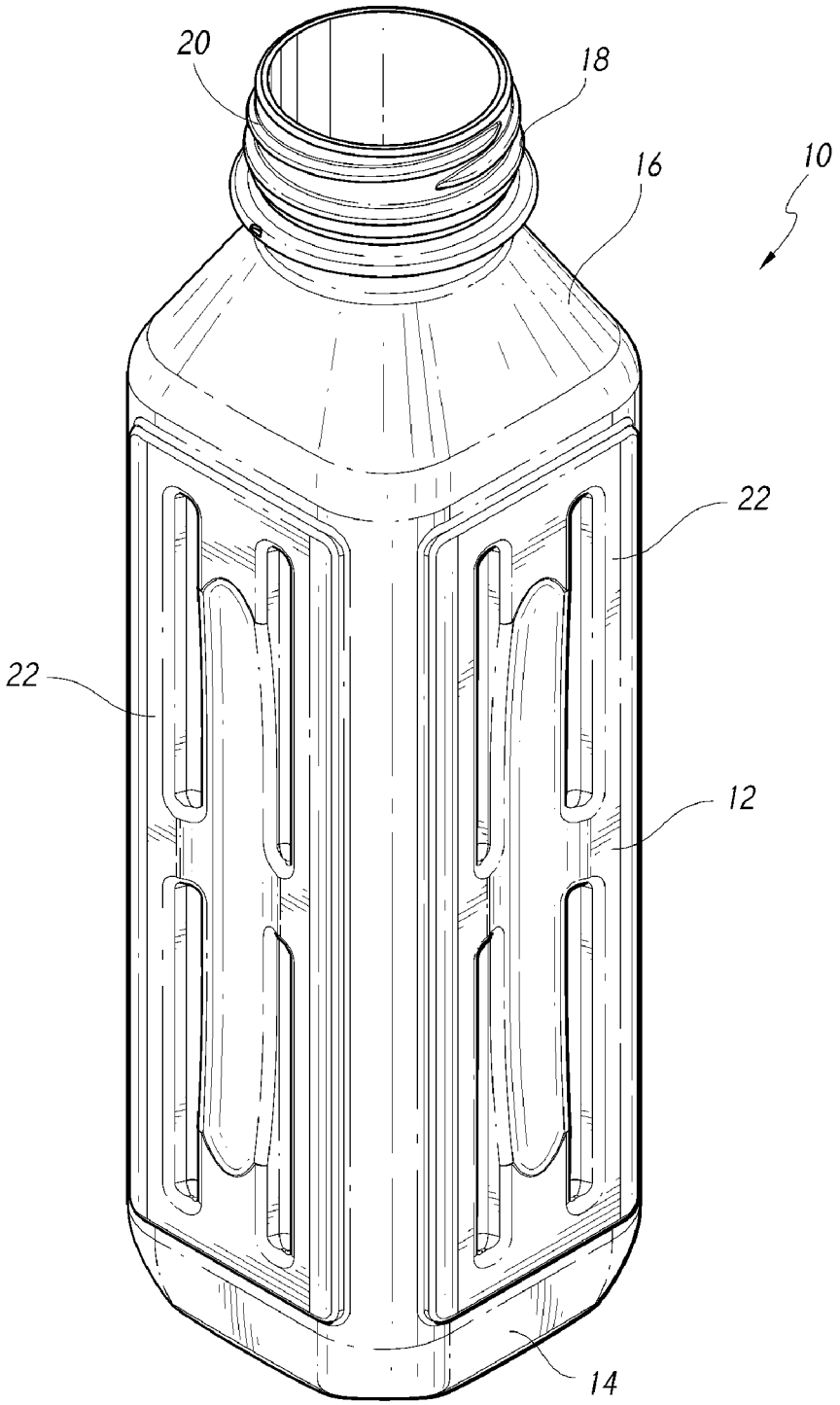
FIG. 1 is an isometric view of a plastic container that is constructed according to a preferred embodiment of the invention.
Figure 2:
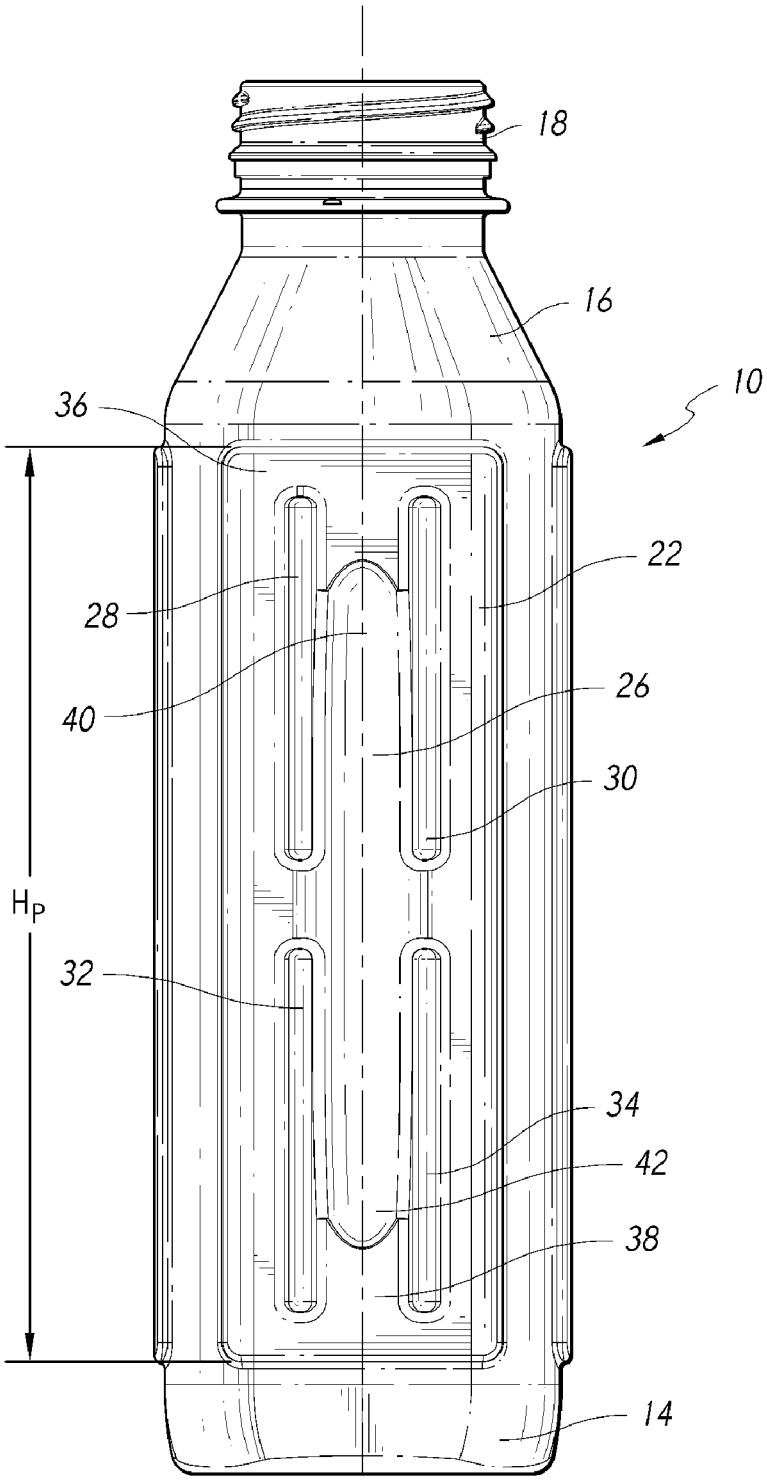
FIG. 2 is a front elevational view of the plastic container that is shown FIG. 1.
Figure 3:
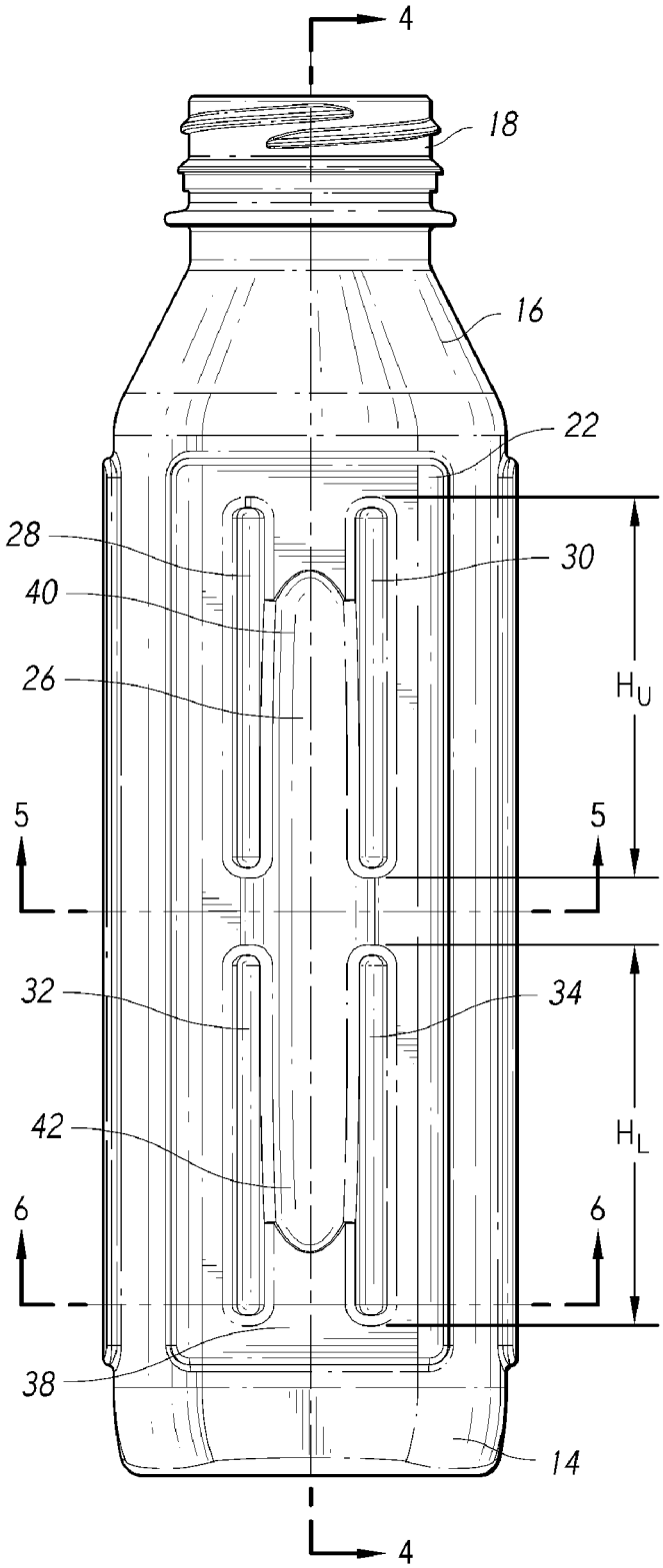
FIG. 3 is a side elevational view of the plastic container that is shown in FIG. 1.

Referring now to the drawings, wherein like reference numerals designate corresponding structure throughout the views, and referring in particular to FIG. 1, a plastic container 10 that is constructed according to a preferred embodiment of the invention includes a main body portion 12 and a bottom portion 14 that is unitary with the main body portion 12. Container 10 further includes a shoulder portion 16 connecting the main body portion 12 to a finish portion 18 that is provided with one or more external threads 20 to which a closure such as a screw cap may be mounted.

The plastic container 10 is preferably fabricated from a material such as polyethylene terephthalate (PET) using the reheat stretch blow molding process.

Figure 5:
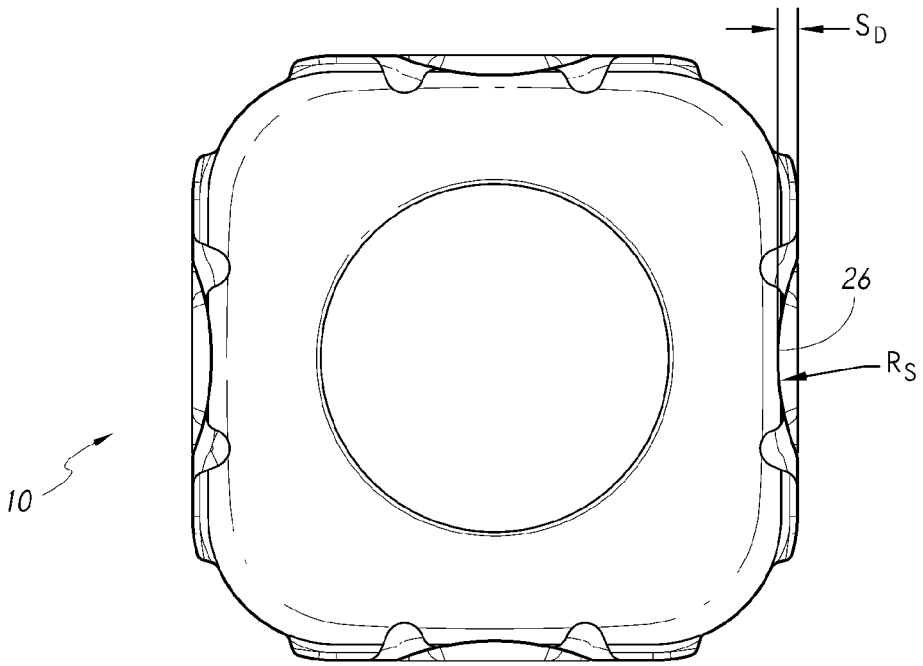
FIG. 5 is a cross-sectional view taken along lines 5-5 in FIG. 3.
Figure 6:
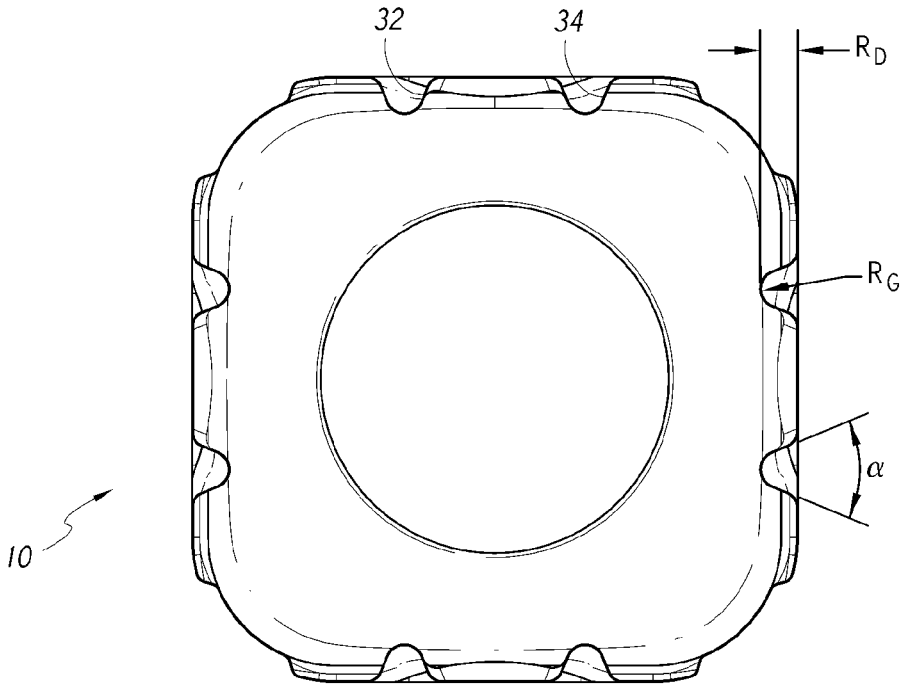
FIG. 6 is a cross-sectional view taken along lines 6-6 in FIG. 3.

Main body portion 12 has a substantially rectangular shape when viewed in transverse cross-section, as is shown in FIGS. 5 and 6. A plurality of side panels 22 are defined on the main body portion 12. In the preferred embodiment, the main body portion 12 is substantially square when viewed in transverse cross-section, and each of the plurality of side panels 22 is substantially identical in size and shape.

Each of the side panels 22 preferably includes a longitudinally oriented concave scoop 26 that extends continuously from an upper portion 36 of the side panel 22 to a lower portion 38 of the side panel 22. The side panel 22 also preferably includes a first pair of longitudinally oriented concave ribs 28, 30 that are positioned adjacent to an upper portion 40 of the scoop 26, and a second pair of longitudinally oriented concave ribs 32, 34 that are positioned adjacent to a lower portion 42 of the scoop 26.

Each of the side panels 22 is furthermore substantially rectangular as viewed in side elevation.

In the preferred embodiment, each of the longitudinally oriented concave ribs 28, 30, 32, 34 has substantially the same maximum depth $R_D$, as is shown diagrammatically in FIG. 6.

The main body portion 12 is advantageously constructed so as to have no narrowed waist portion that would need to be bridged by a label.

The first pair of ribs 28, 30 is preferably substantially symmetrical in size and in shape. Similarly, the second pair of ribs 32, 34 is preferably substantially symmetrical in size and in shape. The two pairs of ribs are also preferably aligned with respect to each other so that the rib 28 is in substantial alignment with the rib 32, and the rib 30 is in substantial alignment with the rib 34.

Figure 4:
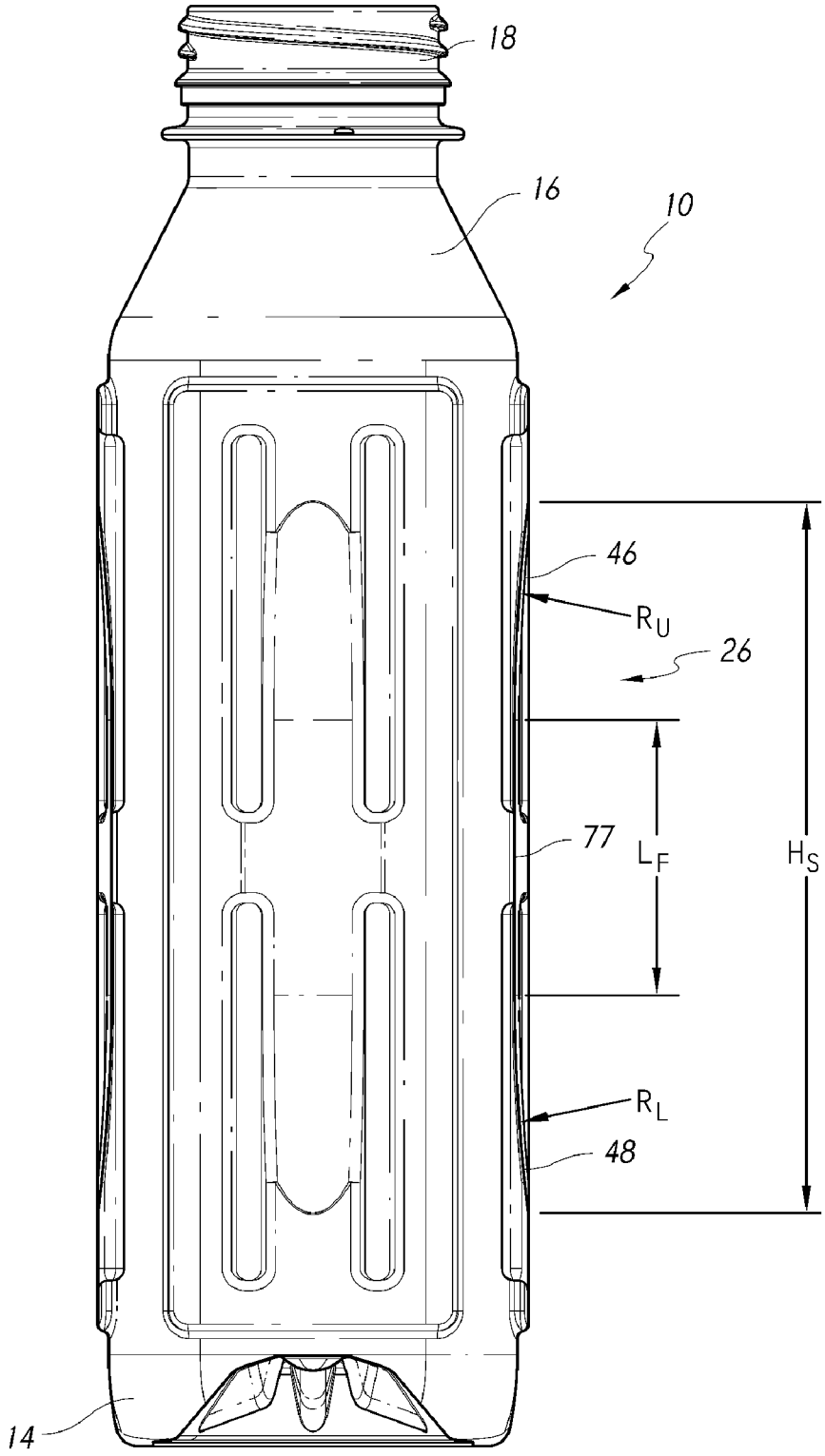
FIG. 4 is a cross-sectional view taken along lines 4-4 in FIG. 3.

Referring to FIG. 4, it will be seen that the scoop 26 when viewed in longitudinal cross-section has a substantially flat portion 77, an upper concave portion 46 having a first average radius $R_U$ and a lower concave portion 48 having a second average radius $R_L$. A ratio of at least one of the upper and lower average radii $R_U$, $R_L$ to a length $L_F$ of the flat portion 77 is preferably substantially within a range of about 4.0 to about 10.0, more preferably substantially within a range of about 5.0 to about 9.0 and most preferably substantially with a range of about 5.5 to about 7.5.

In the preferred embodiment, the upper average radius $R_U$ is substantially the same as the lower average radius $R_L$.

At least one of the ribs 28, 30, 32, 34 has a first maximum depth $R_D$, and the scoop 26 has a second maximum depth $S_D$. Preferably, a ratio of the first maximum depth $R_D$ to the second maximum depth $S_D$ is substantially within a range of about 1.0 to about 3.0, more preferably substantially within a range of that 1.5 to about 2.5 and most preferably substantially within a range of about 1.75 to about 2.25.

Ribs 28, 30, 32, 34 further have opposing sidewalls that define an angle $\alpha$, which in the preferred embodiment is substantially within a range of about 30 degrees to about 60 degrees.

One of the first pair of ribs 28, 30 has a first height $H_U$ and, as is discussed above, is substantially aligned with one of the second pair of ribs 32, 34, which has a second height $H_L$. The sum of the first and second heights $H_U$, $H_L$ defines a total rib height. Preferably, a ratio of the total rib height to a height $H_P$ of the panel is substantially within a range of about 0.5 to about 0.95. More preferably, this ratio is substantially within a range of about 0.6 to about 0.9, and most preferably it is substantially within a range of about 0.7 to about 0.85.

The scoop 26 has a maximum height $H_S$, and a ratio of the maximum height $H_S$ of the scoop to the maximum height $H_P$ of the side panel 22 is preferably substantially within a range of about 0.6 to about 0.85 and more preferably substantially within a range of about 0.7 to about 0.8.

The scoop 26 as viewed in transverse cross-section has an average radius $R_S$, and each of the grooves 28, 30, 32, 34 has an average radius $R_G$. A ratio of the average radius $R_S$ of the scoop 26 to the average radius $R_G$ of the grooves is preferably substantially within a range of about 0.04 to about 0.1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A blow molded plastic container, comprising:

a main body portion having a substantially rectangular shape when viewed in transverse cross-section;

a plurality of side panels on the main body portion, at least one of the side panels having a longitudinally oriented concave scoop extending continuously from an upper portion of the side panel to a lower portion of the side panel, the side panel further including a first pair of longitudinally oriented concave ribs positioned adjacent to an upper portion of the scoop and a second pair of longitudinally oriented concave ribs positioned adjacent to a lower portion of the scoop.

2. A blow molded plastic container according to claim 1, wherein the scoop as viewed in longitudinal cross-section has a central substantially flat portion, an upper concave portion having a first average radius and a lower concave portion having a second average radius, and wherein a ratio of at least one of the first and second average radii to a length of the flat portion is substantially within a range of about 4.0 to about 10.0.

3. A blow molded plastic container according to claim 2, wherein the ratio is substantially within a range of about 5.0 to about 9.0.

4. A blow molded plastic container according to claim 3, wherein the ratio is substantially within a range of about 5.5 to about 7.5.

5. A blow molded plastic container according to claim 2, wherein the first radius is substantially the same as the second radius.

6. A blow molded plastic container according to claim 1, wherein at least one of the ribs has a first maximum depth and the scoop has a second maximum depth, and wherein a ratio of the first maximum depth to the second maximum depth is substantially within a range of about 1.0 to about 3.0.

7. A blow molded plastic container according to claim 6, wherein the ratio of the first maximum depth to the second maximum depth is substantially within a range of about 1.5 to about 2.5.

8. A blow molded plastic container according to claim 7, wherein the ratio of the first maximum depth to the second maximum depth is substantially within a range of about 1.75 to about 2.25.

9. A blow molded plastic container according to claim 6, wherein all of the ribs have substantially the same maximum depth.

10. A blow molded plastic container according to claim 1, wherein one of the first pair of ribs has a first height and is substantially aligned with one of the second pair of ribs, which has a second height, and wherein a sum of the first height and second height defines a total rib height, and wherein a ratio of the total rib height to a height of the panel is substantially within a range of about 0.5 to about 0.95.

11. A blow molded plastic container according to claim 10, wherein the ratio of the total rib height to the height of the panel is substantially within a range of about 0.6 to about 0.9.

12. A blow molded plastic container according to claim 11, wherein the ratio of the total rib height to the height of the panel is substantially within a range of about 0.7 to about 0.85.

13. A blow molded plastic container according to claim 1, wherein the scoop has a first height and the panel has a second height, and wherein a ratio of the first height to the second height is substantially within a range of about 0.5 to about 0.95.

14. A blow molded plastic container according to claim 13, wherein a ratio of the first height to the second height is substantially within a range of about 0.6 to about 0.85.

15. A blow molded plastic container according to claim 14, wherein a ratio of the first height to the second height is substantially within a range of about 0.7 to about 0.8.

16. A blow molded plastic container according to claim 1, wherein the main body portion has no waist portion.

17. A blow molded plastic container according to claim 1, wherein the panel is substantially rectangular as viewed in side elevation.

18. A blow molded plastic container according to claim 1, wherein each of the first pair of ribs are substantially symmetrical with respect to each other in size and shape.

19. A blow molded plastic container according to claim 18, wherein each of the second pair of ribs are substantially symmetrical with respect to each other in size and shape.

* * * * *